United States Patent [19]

Anstead

[11] Patent Number: 4,895,330

[45] Date of Patent: Jan. 23, 1990

[54] CANE HOLDER

[76] Inventor: Richard F. Anstead, 52 Summer St., Norwell, Mass. 02061

[21] Appl. No.: 323,508

[22] Filed: Mar. 13, 1989

[51] Int. Cl.[4] ..... A47G 29/00

[52] U.S. Cl. ..... 248/229; 248/231.6

[58] Field of Search ..... 248/540, 110, 111, 113, 248/214, 229, 231.4, 231.6, 231.7; 24/330, 336, 523, 524

[56] References Cited

U.S. PATENT DOCUMENTS

| | | | |
|---|---|---|---|
| 1,000,834 | 8/1911 | McNamee | 248/214 |
| 1,286,649 | 12/1918 | Kayser | 248/231.7 |
| 1,431,485 | 10/1922 | Peck . | |
| 1,439,067 | 12/1922 | Cole | 248/229 |
| 1,459,445 | 6/1923 | Elderton | 24/523 |
| 1,633,190 | 6/1927 | Rader | 248/229 |
| 1,680,723 | 8/1928 | Bloom | 248/229 |
| 1,895,656 | 1/1933 | Gadke | 248/229 |
| 2,006,897 | 7/1935 | Kirkland | 248/231.4 |
| 2,206,775 | 7/1940 | Hoofer | 40/10 |
| 2,530,470 | 11/1950 | Kenly | 65/65 |
| 2,675,979 | 4/1954 | Vetterli | 248/113 |
| 4,709,891 | 12/1987 | Barnett | 248/231.7 |

FOREIGN PATENT DOCUMENTS

| | | |
|---|---|---|
| 2005165 | 3/1971 | Fed. Rep. of Germany . |
| 624313 | 11/1975 | France . |

*Primary Examiner*—Ramon O. Ramirez
*Assistant Examiner*—Robert A. Olson
*Attorney, Agent, or Firm*—Lahive & Cockfield

[57] ABSTRACT

Disclosed is a cane holder for attaching and detaching a cane from a table top or other generally planar member. The holder has a body, a flange and a means for securing the body and flange to the table top. The body has a substantially cylindrical tubular section that interferingly engages the cane or crutch to be held. The means for securing the body and flange to a table top may comprise a spring biased rod having a knob on one end and a substantially U-shape on the opposite end. Alternatively, the securing means may comprise a second flange that is connected to the first flange; the second flange has a first portion extending in a plane substantially parallel to the longitudinal axis of the body's cylindrical tubular section, and a second portion which extends obliquely toward the first flange.

7 Claims, 1 Drawing Sheet

CANE HOLDER

BACKGROUND OF THE INVENTION

The present invention relates to an apparatus for securing a cane to a generally planar surface such as a table or desk top.

Canes are often used for movement and support by aged, and permanently or temporarily handicapped individuals. These devices typically include a cylindrical support pole and a handhold structure. The size of the handhold structure remains relatively constant. The length of the support pole varies depending on the distance between users' hand, at extension, and foot; the support's diameter is relatively constant for all types of canes. The support may be hollow or solid.

Although required for mobility, canes become unnecessary when the individual is, e.g., seated or reclined and, accordingly, must be stored by the user. During non-use canes may be stored by placing them against a wall or other surface within the proximity of the user. Canes placed in such positions, however, often slide on the wall surface, and fall to the ground making it difficult, if not awkward, for the user to retrieve the cane without some outside assistance.

Many attempts have been made to secure cylindrical objects, such as canes, to table tops or other planar surfaces. However, for the most part, these holders require extensive manipulation by the user to connect and disconnect the cane, table top, and the cane holder itself.

The present invention eliminates the above-mentioned problems by requiring only limited manipulation to interconnect the cane, holder, and table top. In particular, the cane is easily placed in the body of the holder by pressing it through an opening in the holder's body, i.e., the spring clip. To remove the cane, the user need only pull the cane such that it pivots on the lower interior edge of the body; as the cane pivots it is forced out of the holder through the opening in the spring clip. Similarly, the holder may be easily attached to, or detached from, a table top by simply pressing on a spring-biased rod located in the holder's flange while sliding the holder onto, or off of, a table top or other planar structure.

Accordingly, it is a primary object of the invention to provide an apparatus which allows for the convenient and safe attachment and removal of a cane to a table top or other generally planar member.

SUMMARY OF THE INVENTION

The present invention attains the preceding objects and features by providing an apparatus for temporarily securing a cane to a table top or other similar planar structure. The apparatus of the present invention comprises a body, such as a spring clip, a flange, and a means for securing the body and flange to a generally planar structure.

According to the invention the body of the cane holder includes a substantially cylindrical tubular section which receives a cane via an opening in the cylindrical section wall. This opening is roughly parallel to a longitudinal axis of the tubular section. A flange, extending substantially normal to the longitudinal axis of the cylinder, is connected to the body. The body and flange may be removably secured to a table top or other generally Planar member by pressure from a threaded or non-threaded, spring-biased rod; the rod extends through the flange and is substantially perpendicular to it. Typically, one of the rod's ends has a knob while the other end is generally U-shaped. A cylindrically or spherically-shaped resilient material may be secured on the U-shaped end of the rod. If a threaded rod is used, a nut or the knob may be disposed on the rod's threads and used to adjust and fix the distance between the rod's U-shaped end and the flange. The rod may have a circular or square cross section.

In an alternative embodiment of the invention the body and flange are secured to a table top or other generally planar member by a second flange. The second flange is attached to that edge of the first flange which is adjacent to the body. Typically, the second flange has a first portion extending in a plane substantially parallel to the longitudinal axis of the body's cylindrical tubular section, and a second portion which extends obliquely toward the first flange.

DETAILED DESCRIPTION

Figure 1:
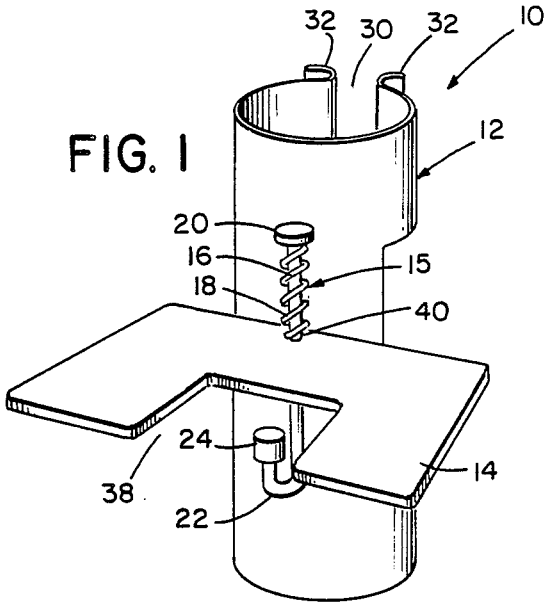
FIG. 1 is a perspective view illustrating a first embodiment of the invention.

Referring to FIGS. 1 through 4, wherein like reference numerals refer to like parts, there is illustrated a cane holder 10. Cane holder 10 includes a body 12 having a flange 14 affixed to its external surface. Either rod assembly 15, or a second flange 50, may be used to secure body 12 and flange 14 to a table top or other generally planar member.

Body 12 may be configured for use with any cylindrical object, including a cane, crutch, umbrella handle, or the like. The body 12 includes a cylindrically shaped tubular section 28 having a side opening 30; the opening 30 is generally parallel to a longitudinal axis of the body's tubular section 28. Opening 30 is sufficiently wide to allow for the passage of a cane, or other cylindrical object, yet will not compromise the ability of the body 12 to interferingly engage the cane. The opening 30 preferably has lips 32, which are turned back away from opening 30, and assist the user in pressing a cane into the tubular section 28. Preferably, the lips 32 are bent away from opening 30 at an angle of approximately between 90° and 155°.

Flange 14 is attached to body 12 by rivets, welding or the like. The flange 14 is oriented generallY normal to a longitudinal axis of the tubular section 28. Flange 14 may be constructed of virtually any strong, durable material, such as aluminum, stainless steel, or polymeric composites. Flange 14 preferably is of sufficient size to provide mechanical support for the holder body 12 and, of course, a cane. Flange 14 has a generally rectangular shape, and typically has a square cut-out 38 in the edge opposite that secured to the body 12. The flange 14 may have an aperture 40; the aperture 40 accommodates rod 16 of the rod assembly 15.

Preferably, rod assembly 15 includes a rod 16 with a knob 20 attached to one end and a generally U-shaped form 22 on the opposite end. The rod may be manufactured from square stock, such as "shaft key" stock, to decrease the effect of a twisting motion caused by an inapparent application of a "side moment" or "force" during use of the cane holder. A spring 18 encases the rod 16; the ends of spring 18 engage the opposing faces of knob 20 and flange 14. The spring 18 biases the U-shaped end 22 of rod 16 toward flange 14. A resilient material 24 may be secured on the U-shaped end 22.

FIG. 1 illustrates an embodiment of the invention in which rod assembly 15 is used to secure the body 12 and flange 14 to a table top or other generally planar member. The rod assembly 15 includes a rod 16 having a knob 20 on one end and a generally U-shape 22 on the opposite end. The rod is encased in a spring 18; the spring 18 bears against the opposing faces of flange 14 and knob 20. The knob 20 is typically circular, however, other ergonomically feasible shapes may be used. Preferably, the knob 20 is of sufficient size to provide a surface against which the spring 18 may bear. Spring 18 may be made of any resilient material so long as it produces sufficient force to bias the U-shaped end 22 of rod 16 toward the flange 14. Preferably, a cylindrically-shaPed resilient material 24 is secured to the U-shaped end 22. The resilient material 24 may be manufactured from any material which is temporarily deformable and skid-resistant yet retains a memory of its original shape.

Figure 2:
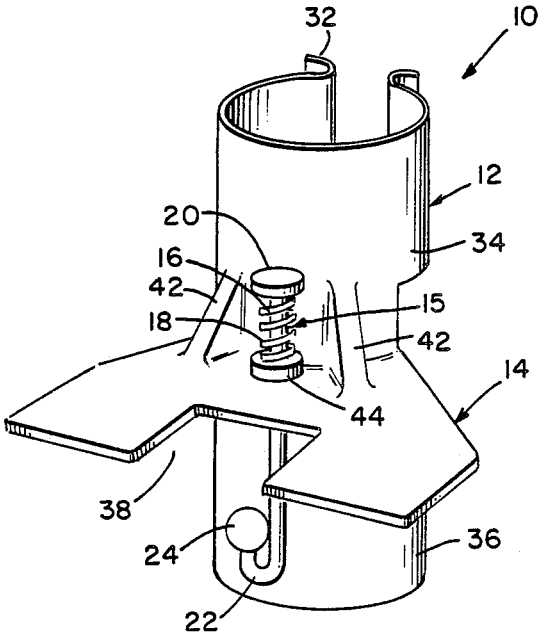
FIG. 2 is a perspective view illustrating a preferred embodiment in accordance with the present invention.

The preferred embodiment of the cane holder 10, illustrated in FIG. 2, generally comprises a holder body 12, a flange 14, and rod assembly 15. Two supports 42 reinforce the attachment of body 12 to flange 14. The body 12 is approximately three inches long and has a cylindrical tubular section with an inside diameter of approximately one-half to three-quarters of an inch. In addition, the body 12 comprises integral upper and lower sections 34 and 36.

The flange 14 of the preferred embodiment is polygonal in shape and has a generally square cutout 38 in the side opposite that attached to body holder 12. The flange 14 has a length and width of between three and five inches. Of course, the dimensions of the flange may be altered as the strength requirements of the cane holder are adjusted for various size canes.

The rod assembly 15, includes a rod 16 and spring 18. The rod 16 has a knob 20 and a generally U-shaped end 22. Rod 16 is threaded at the top to accept knob 20. Knob 20 is of sufficient size to meet both the ergonomic requirements of the user and provide a sufficient surface area for spring 18 to engage. In operation, rod 16 and knob 20 cooperate to compress or expand spring 18. The cooperative action of the rod 16 and knob 20 provides a means by which the position of the generally U-shaped end 22 will have infinite adjustment vis-a-vis the flange 14. A spherically-shaped resilient material 24 is located on the U-shaped end 22 of the rod 16.

Figure 3:
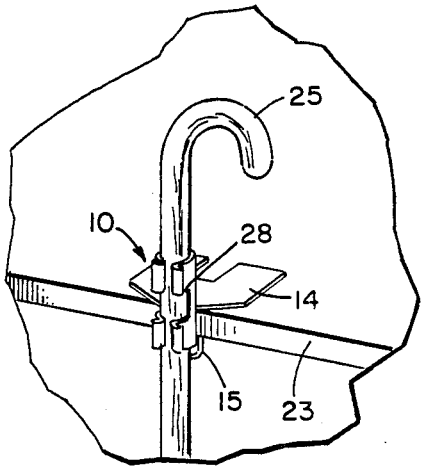
FIG. 3 illustrates the preferred embodiment of the invention with a cane placed in the body of the holder and the holder secured to a table top.

FIG. 3 shows the preferred embodiment of the invention with cane 25 inserted into tubular section 28. The cane holder 10 is secured to a table top 23 by the interaction of rod assembly 15 and flange 14. In particular, by exerting a force against the knob 20, spring 18 biases both the U-shaped end 22 of rod 16 and the flange 14 toward the surfaces of table top 23. A spherically-shaped resilient material 24 protects the surface of table top 23 from being marred by rod 22, and assures that rod 22, and hence cane holder 10, will not slide on table top 23.

Figure 4:
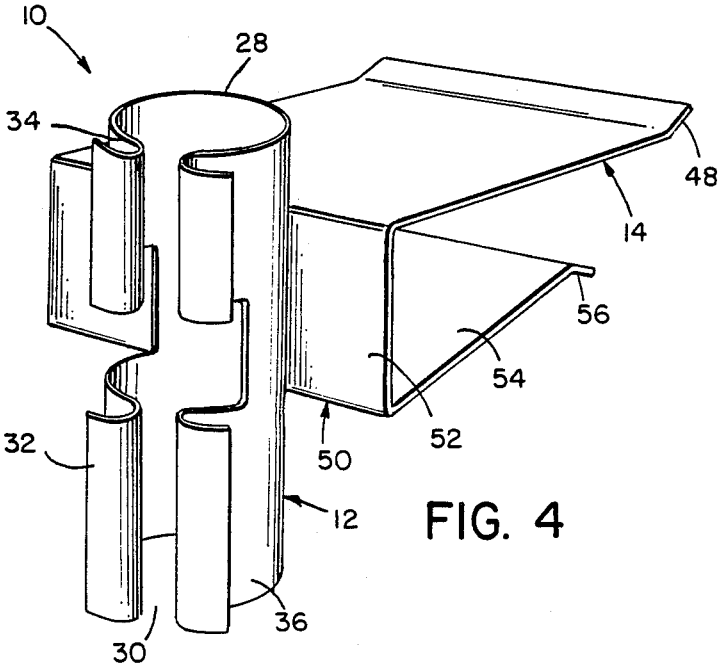
FIG. 4 is a perspective view illustrating a third embodiment of the invention.

FIG. 4 illustrates an alternative embodiment of the cane holder 10. The apparatus of this embodiment includes a body 12 connected to a first flange 14; a second flange 50 is connected to the first flange 14. The body 12 of this embodiment comprises integral upper and lower sections 34 and 36. In addition, sections 34 and 36 have an opening 30 with lips 32. The flange 14, which is oriented in a plane generally normal to the longitudinal axis of tubular section 28, has an edge 48 which is slightly upturned. The upturned edge 48 prevents the flange 14 from marring the surface of table tops to which the flange will be connected during use.

A second flange 50 is attached to that edge of flange 14 which is adjacent to body 12. Second flange 50 provides a means for securing the body 12 and flange 14 to a table top or other generally planar member. The second flange 50 preferably has a first portion 52 and a second portion 54. Portion 52 is generally parallel to the longitudinal axis of tubular section 28, and between one-half and three-quarters of an inch long. Second portion 54 of flange 50 extends obliquely toward flange 14. The second portion 54 is typically two to three inches long. The second portion 54 of flange 50 also has an upturned edge 56. Upturned edge 56 acts to prevent flange 50 from marring the planar member's surface during use of the cane holder 10.

Although particular embodiments of this invention have been described and illustrated herein, it is recognized that modifications and variations may readily occur to those skilled in the art. Consequently, it is intended that the claims be interpreted to cover such modifications and the equivalents.

What is claimed is:

1. An apparatus for removably holding a cane on a generally planar member comprising:

a body having an elongate, substantially cylindrical tubular section and an opening for receiving said cane into said tubular section, said opening being substantially parallel to a longitudinal axis of said tubular section; and a flange connected to said body, said flange extending in a plane substantially normal to the longitudinal axis of said tubular section; and a means for securing said body and said flange to said generally planar member which is substantially normal to the longitudinal axis of said tubular section, said means for securing said body and said flange to said generally planar member comprising a spring-biased rod oriented substantially perpendicular to said flange and passing through an aperture in said flange, said spring-biased rod having a knob on one end and being substantially U-shaped on the opposite end, and biased such that said substantially U-shaped portion of said rod is biased toward said flange.

2. The apparatus of claim 1 wherein said body comprises a spring clip.

3. The apparatus of claim 1 wherein said rod has a square cross-section.

4. The apparatus of claim 1 wherein said rod has a cylindrically-shaped, resilient material on the substantially U-shaped end of said rod.

5. The apparatus of claim 1 wherein said spring-biased rod is threaded.

6. The apparatus of claim 5 wherein said spring-biased rod is disposed such that alteration of the position of the rod acts to modify the distance between the substantially U-shaped end of said rod and a face of said flange adjacent to said substantially U-shaped end.

7. The apparatus of claim 6 wherein said rod has a spherically-shaped, resilient material on the substantially U-shape end of said rod.

* * * * *

UNITED STATES PATENT AND TRADEMARK OFFICE

CERTIFICATE OF CORRECTION

PATENT NO. : 4,895,330

DATED : 23 January 1990

INVENTOR(S) : Richard F. Anstead

It is certified that error appears in the above-identified patent and that said Letters Patent is hereby corrected as shown below:

Column 1, line 67, delete "Planar" and insert --planar--.

Column 2, line 55, delete "generallY" and insert --generally--.

Column 3, lines 22-23, delete "cylindrically-shaPed" and insert --cylindrically-shaped--.

Signed and Sealed this

Seventeenth Day of December, 1991

*Attest:*

*Attesting Officer*

HARRY F. MANBECK, JR.

*Commissioner of Patents and Trademarks*